US007102471B2

(12) United States Patent
Godesa

(10) Patent No.: US 7,102,471 B2
(45) Date of Patent: Sep. 5, 2006

(54) ELECTRICAL POWER BREAKER WITH A SWITCHING CONTACT ARRANGEMENT HAVING A CURRENT LOOP

(75) Inventor: Ludvik Godesa, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 461 days.

(21) Appl. No.: 10/607,055

(22) Filed: Jun. 27, 2003

(65) Prior Publication Data

US 2004/0001297 A1 Jan. 1, 2004

(30) Foreign Application Priority Data

Jun. 27, 2002 (DE) ..... 102 30 085

(51) Int. Cl.
*H01H 75/00* (2006.01)

(52) U.S. Cl. ..... 335/16; 335/147; 200/244

(58) Field of Classification Search ..... 335/16, 335/147, 195; 218/22, 30, 32–33; 200/238, 200/244

See application file for complete search history.

(56) References Cited

U.S. PATENT DOCUMENTS 4,849,590 A * 7/1989 Becker et al. ..... 218/33
4,853,662 A 8/1989 Kandatsu
6,184,761 B1 2/2001 Doma et al.
2002/0050878 A1 5/2002 Ferree et al.
2003/0052758 A1* 3/2003 Raabe et al. ..... 335/16

FOREIGN PATENT DOCUMENTS

EP 0006637 B1 7/1979

* cited by examiner

*Primary Examiner*—Lincoln Donovan
(74) *Attorney, Agent, or Firm*—Harness, Dickey & Pierce, P.L.C.

(57) ABSTRACT

A power breaker includes a switching contact arrangement having a current loop in order to allow a force dependent on the current to act on the contact members. For this purpose, sections, which are arranged parallel to one another and such that they are arched and concentric, are arranged on a stationary current conductor and on a contact lever. Depending on the position of a center of a resultant force, originating from the arched sections, in relation to a pivot bearing of the contact lever, a torque acts on the contact lever causing the switching contact arrangement to open or close. Using largely identical parts, power breakers which have a current-limiting or contact-force-increasing action can thus be produced.

15 Claims, 3 Drawing Sheets

ELECTRICAL POWER BREAKER WITH A SWITCHING CONTACT ARRANGEMENT HAVING A CURRENT LOOP

The present application hereby claims priority under 35 U.S.C. §119 on German patent application number DE 10230085.2 filed Jun. 27, 2002, the entire contents of which are hereby incorporated herein by reference.

FIELD OF THE INVENTION

The invention generally relates to an electrical power breaker with a switching contact arrangement. Preferably, it relates to one which includes a current conductor, carrying a stationary contact member, and a contact lever, carrying a moveable contact member. The contact lever may be arranged on a contact carrier, which can pivot in order to close and open the switching contact arrangement, such that it can move about a pivot bearing. The current conductor and the contact lever may lye opposite one another when the switching contact arrangement is closed, so as to form a current loop which generates a torque acting on the contact lever.

BACKGROUND OF THE INVENTION

A power breaker has been disclosed, for example, by EP 0 006 637. It is known from this publication that the force produced in a current loop can be used both for increasing and for decreasing the force between the contact members. Both functions are very useful for power breakers and are used in many different ways. An increase in the force between the contact members is desirable if the time at which the switching contact arrangement opens is intended to be entirely dependent on a protection device, for example an electronic overcurrent release. A prerequisite for this so-called selective response is that the contact members remain closed until the current is at its peak, since otherwise premature erosion of the contact members and other severe damage may occur. A current loop allows high-current-density forces, which are produced in particular between the interacting contact members and are equal in value to the square of the current, to be compensated.

In contrast to this, current-limiting power breakers have the characteristic that the contact members are opened directly in the event of a high current even before a protection device responds. This can be achieved or assisted by a current loop of the type mentioned. In combination with the action of an arc-quenching chamber, the electrical resistance of the switching arc formed when the contact members are separated in this case limits the current to a value which is acceptable to the power breaker and the associated switchgear.

The fact that a considerably different construction is required for the switching contact arrangements for increasing or decreasing the contact force adversely affects the cost-effective production of power breakers. Consequently, selective and current-limiting power breakers known to date differ in major structured features.

SUMMARY OF THE INVENTION

An embodiment of the invention may be based on an object of eliminating at least one of the limitations described and/or and object of allowing selective and current-limiting power breakers to be produced from essentially identical components.

An object may achieved according to an embodiment of the invention by the fact that sections of the current conductor and the contact lever forming the current loop are designed to be arched and concentric with respect to one another, with a radius which approximately corresponds to the distance from the pivot bearing of the contact lever.

The arched and concentric configuration indicates that the elementary force vectors, which together produce the torque acting on the contact lever, cooperate with the same lever arm. This occurs whilst, when the sections forming the current loop are arranged parallel to one another, each of the force vectors contributes to the torque to a different extent. As a result, when the sections lying opposite one another have the same length and in the case of an arched and concentric arrangement, the force available is utilized considerably more effectively.

The abovementioned effective utilization of the available force is a result of the elementary force vectors being focussed on the center of the arched arrangement. The effective lever arm is in this case the distance of this center from the pivot bearing of the contact lever. By this, it is advantageously possible to generate a torque causing the contact members to either close or open without the arrangement and configuration of the current-carrying sections, lying opposite one another, being changed. This can advantageously be brought about by bearing elements being arranged on the contact carrier and/or on the contact lever, which bearing elements cause the pivot bearing of the contact lever to have two different positions in relation to the lever arm, and hereby produce a torque causing the contact members to either close or open.

BRIEF DESCRIPTION OF THE DRAWINGS

The invention is explained in further detail below with reference to the exemplary embodiments shown in the figures, wherein.

DETAILED DESCRIPTION OF THE PREFERRED EMBODIMENTS

Figure 1:
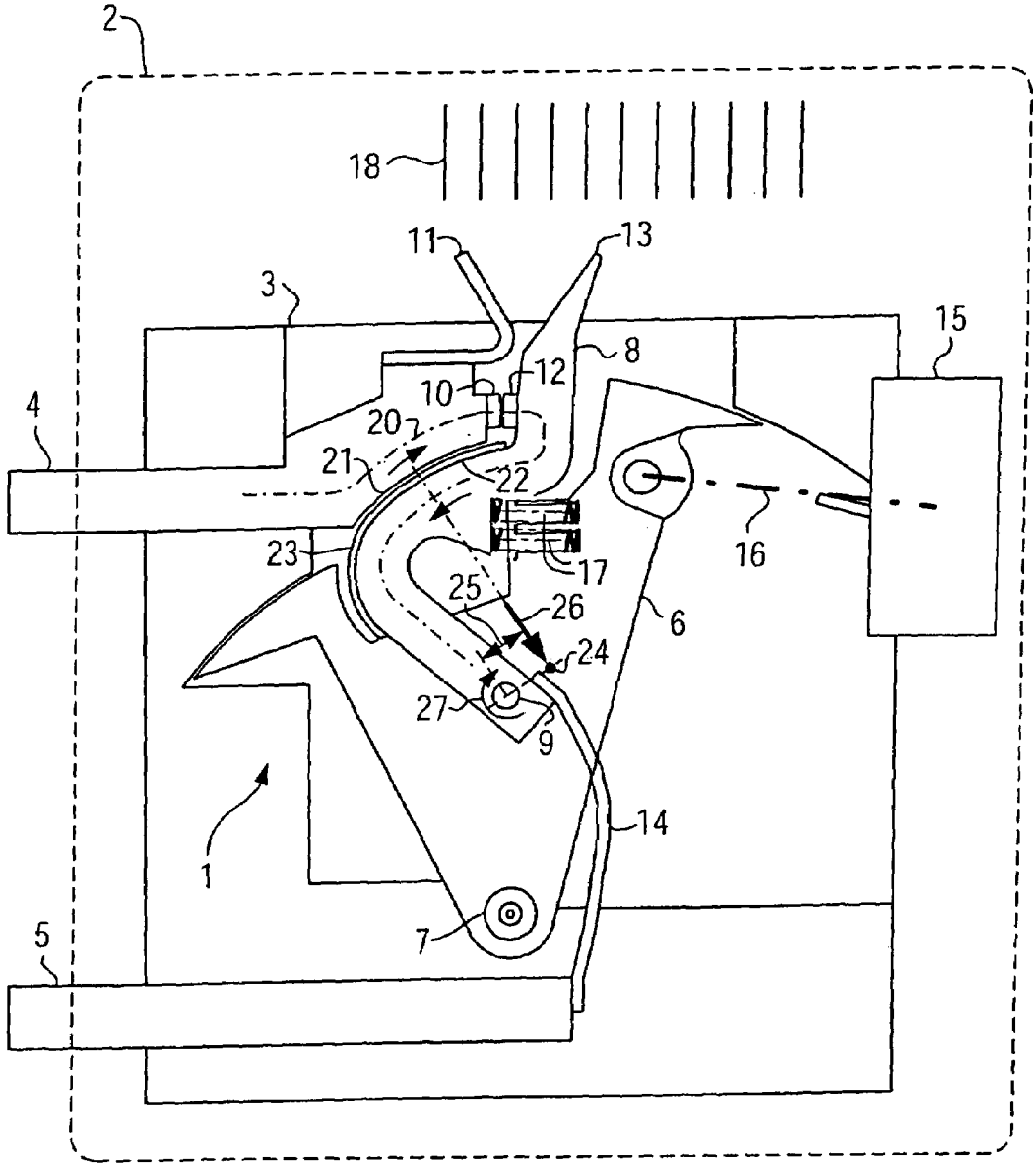
FIG. 1 schematically shows a pole of a low-voltage power breaker having a current loop causing the contact members to open as a form of current limitation.

FIG. 1 shows a switching contact arrangement 1 of a low-voltage power breaker 2, indicated by dashed lines. The switching contact arrangement 1 includes a support or enclosure 3, in which an upper current conductor 4 and a lower current conductor 5 are firmly supported. Further, a contact carrier 6 is mounted such that it can move about a pivot bearing 7, close to the lower current conductor 5. A contact lever 8 is arranged on the contact carrier 6 likewise so that it can move by way of a pivot bearing 9. On its end side situated within the enclosure 3, the current conductor 4 has a stationary contact member 10 and an arcing horn 11. A moveable contact member 12, which is mounted on the contact lever 8 which is likewise provided with an arcing horn 13, cooperates with the stationary contact member 10. A flexible conductor 14 (conductor ribbon, litz wire, etc.) extends between the contact lever 8 and the lower current conductor 5.

A drive apparatus 15, indicated in FIG. 1, serves the purpose of opening and closing the switching contact arrangement 1. This drive apparatus acts on the contact carrier 6 by way of a schematically shown drive linkage 16 and moves it about its pivot bearing 7 such that the contact members 10 and 12 come into contact with, or are separated from, one another. When the latter closes, contact force springs 17, which are arranged between the contact carrier 6 and the contact lever 8, are tensioned. By this, when the switching contact arrangement 1 is closed, the contact members 10 and 12 are subjected to sufficient contact force.

The current path of the switching contact arrangement 1 shown in FIG. 1 contains a current loop 20, indicated by dashed-dotted lines and arrows, which is formed by a particular configuration of the upper current conductor 4 and the contact lever 8. The current loop 20 is formed by sections 21 and 22, respectively, of the current conductor 4 and the contact lever 8, which lie parallel to one another, have an arched curvature and lie opposite one another a slight distance apart. An electrically insulating coating 23 on the contact lever 8 in this case prevents the current from passing between the sections 21 and 22.

The curvature of the concentric sections 21 and 22 is chosen such that the radius approximately corresponds to the distance from the pivot bearing 9 of the contact lever 8. However, the arched sections 21 and 22 are aligned such that the center 24 of the curvature does not coincide with the axis of the pivot bearing 9, but with this pivot bearing 9 forms a lever arm 25.

The switching contact arrangement 1 in accordance with FIG. 1 functions in the following manner:

A current flowing through the current conductors 4 and 5 as well as the contact lever 8 and the flexible conductor 14 is caused to change direction due to the formation of a current loop 20 in adjacent sections 21 and 22 of the upper current conductor 4 and the contact lever 8. By this, the current flows anti-parallel in the sections 21 and 22. In a known manner, this produces a repulsive force which is equal in value to the square of the current and is dependent on the ratio of the length of the parallel sections 21 and 22 to the distance between them.

When the power breaker 2 is in normal operation, this force is low and is overcome by the contact force springs 17. Dimensioning the current loop 20, i.e. dimensioning the length of the sections 21 and 22 and their distance from one another. However, causes this force to reach a significant level if a short-circuit current is flowing through the power breaker 2. Owing to the concentric curvatures of the sections 21 and 22, a resultant force 26 acts in the center 24 by a lever arm 25 and causes a torque to be exerted on the contact lever 8, in the direction of an arrow 27. This is so high that the contact members 10 and 12 are separated counter to the force of the contact force springs 17.

The switching contact arrangement 1 is then further caused to open completely by a mechanically forced or electronically controlled release of a latch in the drive apparatus 15 and/or in the drive linkage 16. In the process, an arc-quenching chamber 18, which is shown schematically above the arcing horns 11 and 13, contributes to quenching the switching arc and thus to interrupting the current circuit. These processes are generally known for power breakers and therefore will not be explained in any further detail.

Figure 2:
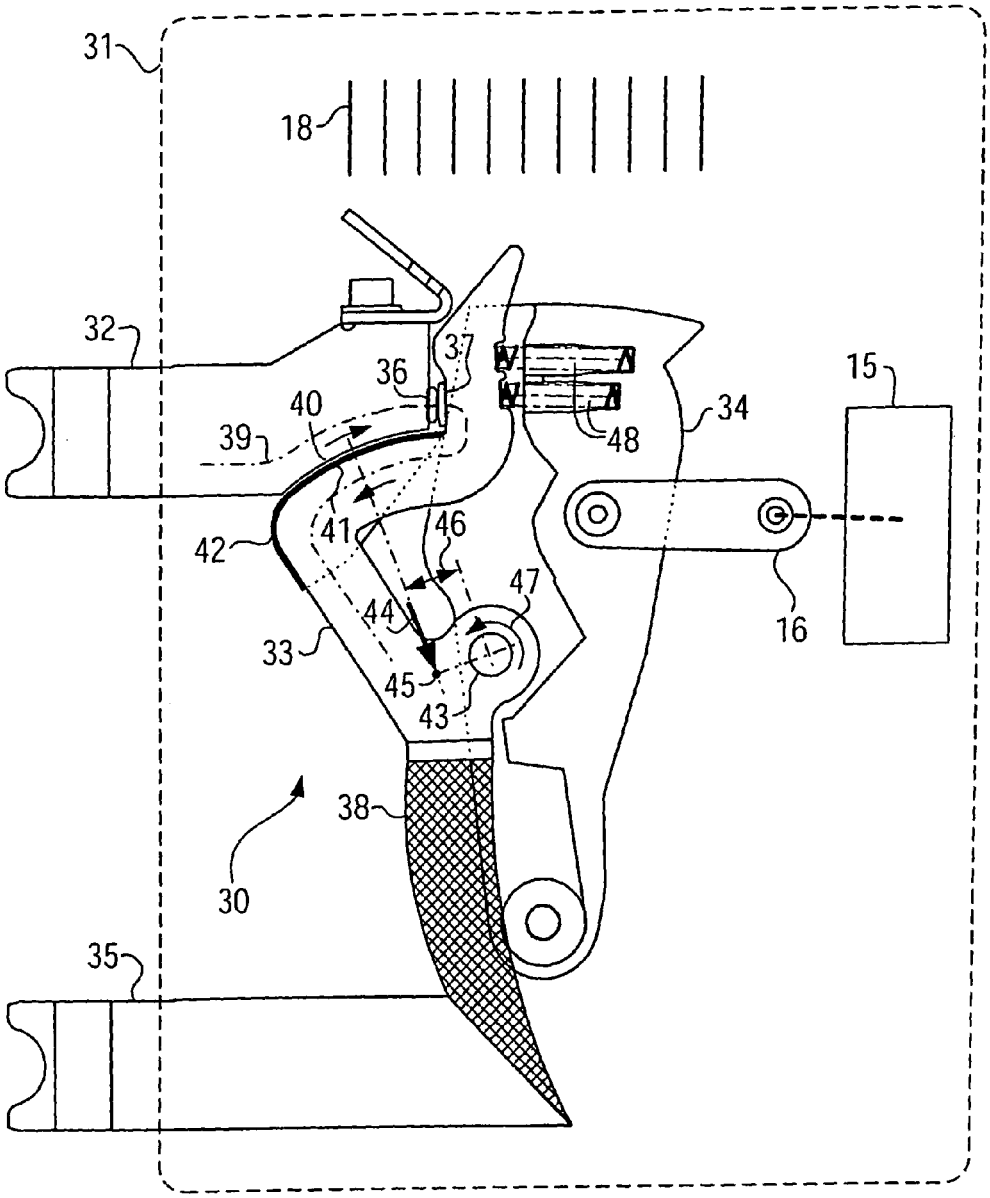
FIG. 2 likewise shows a switching pole of a low-voltage power breaker in section, a current loop causing current to flow through the contact members.

Although the switching contact arrangement 30, shown in FIG. 2, of a power breaker 31 has a largely similar construction to, and practically the same external dimensions as, the switching contact arrangement 1 described above, it does differ from the latter by the fact that a force brought about by the current acts in the opposite direction. For this purpose, the switching contact arrangement 30 has an upper current conductor 32, a contact lever 33 and a contact carrier 34 holding the contact lever 33, as well as a lower current conductor 35.

The current path through the switching contact arrangement 30 extends from the upper current conductor 32, via a stationary contact member 36, a moveable contact member 37 which cooperates with said stationary contact member 36, the contact lever 33 and a flexible conductor 38, to the lower current conductor 35. Furthermore, as with the switching contact arrangement 1 according to FIG. 1, arched and parallel sections 40 and 41 as well as an insulating coating 42 on the contact lever 33 are provided. However, the position of a pivot bearing 43 of the contact lever 33 on the contact carrier 34 is different. This has the result that a resultant force 44 which is produced by a current flowing via the switching contact arrangement causes torque to act on the contact lever 33 in a center 45 with an effective lever arm 46.

The corresponding torque, illustrated by an arrow 47, acts in the counter-clockwise direction and hereby increases the contact force produced between the contact members 36 and 37 by contact force springs 48. By dimensioning the cooperating parts in a suitable manner, a reduction in the contact force, caused by the high-current-density force between the contact members 36 and 37, is compensated, and the switching contact arrangement 30 thus remains closed even at peak currents. The opening of the switching contact arrangement is thus left to a protection device (e.g. digital electronic overcurrent release).

The different functioning of the switching contact arrangements 1 and 30 which has been described is achieved despite them having the same external dimensions and largely similar cooperating parts. This principle is explained below with reference to FIG. 3.

Figure 3:
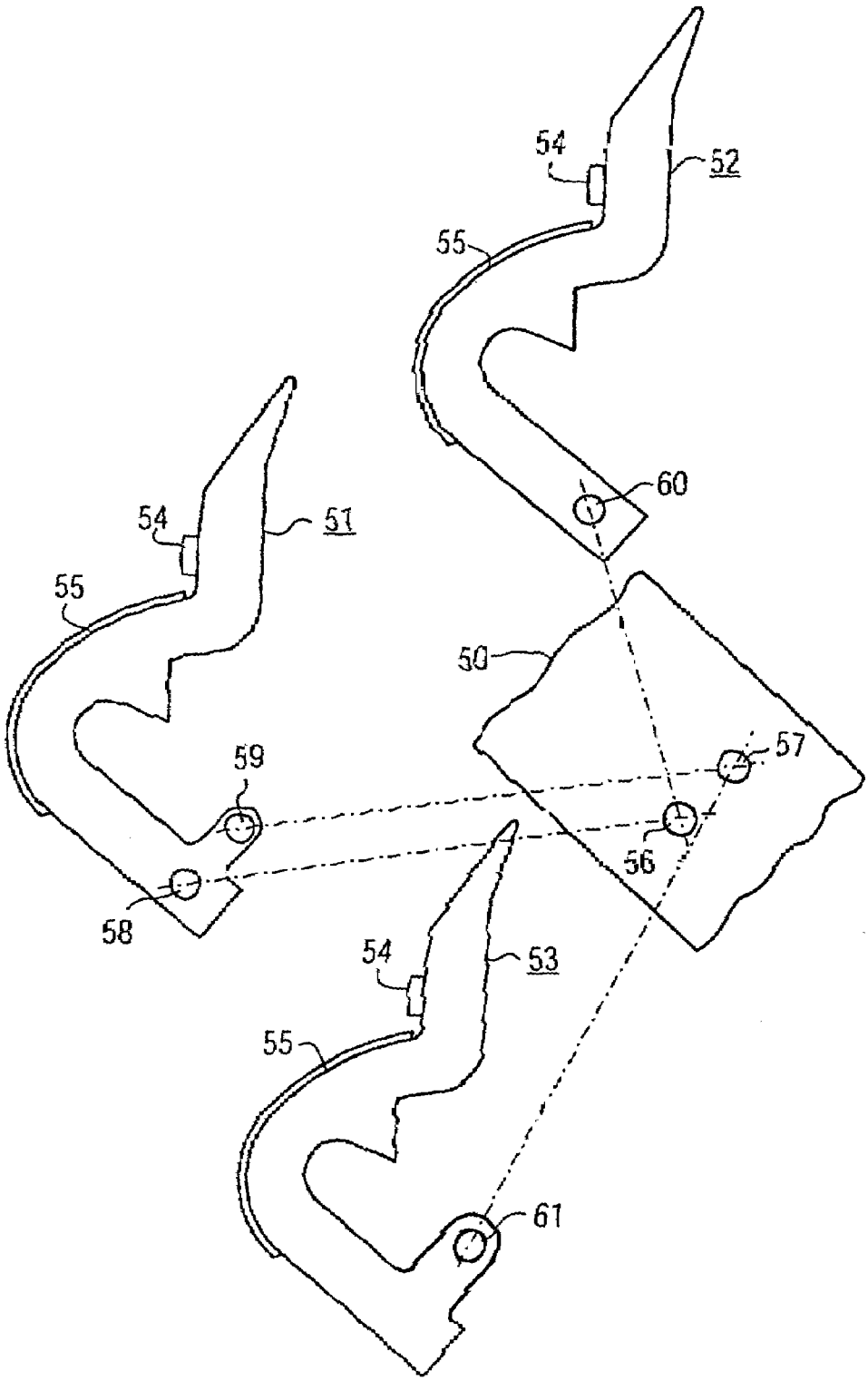
FIG. 3 shows contact levers having differently arranged receptacles for pivot bearings.

In the illustration according to FIG. 3, it is assumed that, for the two types of power breaker explained with reference to FIGS. 1 and 2, the same upper current conductors (not shown) and the same contact carriers 50 (shown in part) are used. Furthermore, the contact levers 51, 52 and 53 shown coinciding with each other in terms of their contact members 54 and the adjacent arched sections 55. This results in the center of the resultant force originating from the arched and concentric sections likewise coinciding.

The desired effect of the torque acting on the contact levers 51, 52, 53 in the clockwise direction or in the counterclockwise direction is achieved by arranging the pivot bearing of the contact levers on the contact carrier 50. The latter has two receptacles for bearing elements (e.g. hinge bolts), of which one receptacle 56 is configured such that it limits the current (FIG. 1) and the other receptacle 57 is configured such that it increases the contact force (FIG. 2). If the contact lever 51 is used, which is likewise provided with two receptacles 58 and 59, then the desired functions are obtained by using the receptacles 56 and 58 or the receptacles 57 and 59, as illustrated by the dashed-dotted lines in FIG. 3. The pivot bearings are formed in a known manner by inserting bearing elements, e.g. cylindrical bearing bolts, in the respective receptacles.

Instead of a common contact lever for both types of power breakers, special contact levers 52 and 53 may be used for current-limiting and contact-force-increasing switching contact arrangements, respectively. These contact levers 52 and 53 each have only one receptacle 60 and 61, respectively, which cooperate, corresponding to the dashed-dotted lines, with the receptacle 56 and 57, respectively, on the contact carrier 52.

If, in the above description of exemplary embodiments, in each case a switching contact arrangement and a contact lever are referred to, this is to be understood as meaning that, in a known manner, a power breaker can be designed to be multipoled (three- or four-poled) and that each of the switching contact arrangements may contain a plurality of parallel contact levers (multicontact system). The pivot bearing of the contact levers is in this case formed, as the common bearing element, by a bearing bolt of corresponding length which passes through the receptacles of all the contact levers and the common contact carrier.

LIST OF REFERENCE NUMERALS

1 Switching contact arrangement (FIG. 1)
2 Power breaker (FIG. 1)
3 Support/enclosure
4 Upper current conductor
5 Lower current conductor
6 Contact carrier
7 Pivot bearing of the contact carrier 4
8 Contact lever
9 Pivot bearing of the contact lever
10 Stationary contact member
11 Stationary arcing horn
12 Moveable contact member
13 Moveable arcing horn
14 Flexible conductor
15 Drive apparatus
16 Drive linkage
17 Contact force spring
18 Arc-quenching chamber
20 Current loop
21 Arched section on the current conductor 4
22 Arched section on the contact lever 8
23 Insulating coating
24 Arrow for resultant force
25 Center of the acting force
26 Arrow for effective lever arm
27 Arrow for torque
30 Switching contact arrangement (FIG. 2)
31 Power breaker (FIG. 2)
32 Stationary current conductor (FIG. 2)
33 Contact lever
34 Contact carrier
35 Lower current conductor
36 Stationary contact member
37 Moveable contact member
38 Flexible conductor
39 Current loop
40 Arched section on the current conductor 32
41 Arched section on the contact lever 33
42 Insulating coating on the contact lever 33
43 Pivot bearing of the contact lever 33
44 Arrow for resultant force
45 Center of the acting force
46 Effective lever arm
47 Arrow for torque
50 Contact carrier (FIG. 3)
51 Contact lever (having two receptacles for pivot bearings)
52 Contact lever (having a receptacle 60)
53 Contact lever (having a receptacle 61)
54 Moveable contact member
55 Arched region on the contact lever 51, 52, 53
56 Receptacle on the contact carrier 50 (for current limitation)
57 Receptacle on the contact carrier 50
58 Receptacle on the contact lever 51 (for current limitation)
59 Receptacle on the contact lever 51 (for increased contact force)
60 Receptacle on the contact lever 52 (for current limitation)
61 Receptacle on the contact lever 53 (for increased contact force)

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical power breaker including a switching contact arrangement, the switching contact arrangement comprising:

a current conductor carrying a stationary contact member; and a contact lever carrying a moveable contact member, said contact lever being arranged on a contact carrier which is pivotable about a pivot bearing to close and open the switching contact arrangement;

wherein a section of the current conductor confronts a section of the contact lever when the switching contact arrangement is closed to form a current loop which generates a torque acting on the contact lever; and wherein the sections of the current conductor and the contact lever forming the current loop are arched and concentric with respect to one another with a radius which approximately corresponds to a distance between the respective sections and a pivot bearing of the contact lever.

2. The power breaker as claimed in claim 1, wherein the concentric sections are shaped to have a curvature center located on a side of the pivot bearing of the contact lever, such that the torque causes the contact members to separate.

3. The power breaker as claimed in claim 1, wherein the concentric sections are shaped to have a curvature center located on a side of the pivot bearing of the contact lever, such that the torque causes the contact members to close.

4. The power breaker as claimed in claim 1, wherein receptacles for bearing elements are arranged on at least one of the contact carrier and the contact lever, and wherein the receptacles cause the pivot bearing of the contact lever to have two different positions in relation to a resultant force originating from the arched sections, and thereby produce a torque causing the contact members to at least one of close and open.

5. The power breaker as claimed in claim 2, wherein receptacles for bearing elements are arranged on at least one of the contact carrier and the contact lever,and wherein the receptacles cause the pivot bearing of the contact lever to have two different positions in relation to a resultant force originating from the arched sections, and thereby produce a torque causing the contact members to at least one of close and open.

6. The power breaker as claimed in claim 3, wherein receptacles for bearing elements are arranged on at least one of the contact carrier and the contact lever, and wherein the receptacles cause the pivot bearing of the contact lever to have two different positions in relation to a resultant force originating from the arched sections, to thereby produce a torque causing the contact members to at least one of close and open.

7. The power breaker as claimed in claim 1, further comprising a drive apparatus, adapted to drive the contact carrier.

8. An electrical power breaker including a switching contact arrangement, the switching contact arrangement comprising:

a current conductor including a stationary contact member; and a contact lever including a moveable contact member, said contact lever being arranged on a contact carrier which is pivotable about a pivot bearing to close and open the switching contact arrangement;

wherein sections of the current conductor and the contact lever are arched and concentric with respect to one another with a radius which approximately corresponds to a distance between the respective sections and a pivot bearing of the contact lever.

9. The power breaker as claimed in claim 8, wherein the concentric sections are shaped to have a curvature center located on a side of the pivot bearing of the contact lever, such that the torque causes the contact members to separate.

10. The power breaker as claimed in claim 8, wherein the concentric sections are shaped to have a cuevature center located on a side of the pivot bearing of the contact lever, such that the torque causes the contact members to close.

11. The power breaker as claimed in claim 8, wherein receptacles for bearing elements are arranged on at least one of the contact carrier and the contact lever, and wherein the receptacles cause the pivot bearing of the contact lever to have two different positions in relation to a resultant force originating from the arched sections, and thereby produce a torque causing the contact members to at least one of close and open.

12. The power breaker as claimed in claim 9, wherein receptacles for bearing elements are arranged on at least one of the contact carrier and the contact lever, and wherein the receptacles cause the pivot bearing of the contact lever to have two different positions in relation to a resultant force originating from the arched sections, and thereby produce a torque causing the contact members to at least one of close and open.

13. The power breaker as claimed in claim 10, wherein receptacles for bearing elements are arranged on at least one of the contact carrier and the contact lever, and wherein the receptacles cause the pivot bearing of the contact lever to have two different positions in relation to a resultant force originating from the arched sections, to thereby produce a torque causing the contact members to at least one of close and open.

14. The power breaker as claimed in claim 8, further comprising a drive apparatus, adapted to drive the contact carrier.

15. A switching contact arrangement for an electrical power breaker, the switching contact arrangement comprising:

a support;

a contact carrier mounted for pivot action on the support;

a contact lever mounted for pivot action on the contact carrier, the contact lever supporting a moveable contact member; and a current conductor including a stationary contact member;

wherein a section of the current conductor and a section of the contact lever are arched and parallel to one another when the moveable contact member contacts the stationary contact member.

* * * * *